United States Patent [19]

Moorehead et al.

[11] Patent Number: 4,699,707

[45] Date of Patent: Oct. 13, 1987

[54] PROCESS FOR PRODUCING LUBRICATION OIL OF HIGH VISCOSITY INDEX FROM SHALE OILS

[75] Inventors: Eric L. Moorehead, Diamond Bar; Sidney Y. Shen, Hacienda Heights, both of Calif.

[73] Assignee: Union Oil Company of California, Los Angeles, Calif.

[21] Appl. No.: 779,939

[22] Filed: Sep. 25, 1985

[51] Int. Cl.[4] ..... C10G 47/16; C10G 65/12

[52] U.S. Cl. ..... 208/57; 208/111; 208/89

[58] Field of Search ..... 208/61, 57, 59, 89, 208/97, 109, 111, 58

[56] References Cited

U.S. PATENT DOCUMENTS

| | | | |
|---|---|---|---|
| 3,523,071 | 8/1970 | Knapp et al. | 208/97 X |
| 3,637,484 | 1/1972 | Hansford | 208/143 |
| 3,642,610 | 2/1972 | Divijak, Jr. et al. | 208/57 X |
| 3,929,617 | 12/1975 | Henry et al. | 208/96 |
| 3,941,680 | 3/1976 | Byson et al. | 208/59 X |
| 4,028,224 | 6/1977 | MacDonald et al. | 208/92 |
| 4,046,674 | 9/1977 | Young | 208/251 H |
| 4,153,540 | 5/1979 | Gorring et al. | 208/89 |
| 4,213,847 | 7/1980 | Chen et al. | 208/111 |
| 4,238,318 | 12/1980 | Kouwenhoven et al. | 208/120 |
| 4,283,271 | 8/1981 | Garwood et al. | 208/59 |
| 4,292,166 | 9/1981 | Gorring et al. | 208/59 |
| 4,294,687 | 10/1981 | Pinaire et al. | 208/89 X |
| 4,347,121 | 8/1982 | Mayer et al. | 208/58 |
| 4,357,232 | 11/1982 | Holland et al. | 208/87 |
| 4,361,477 | 11/1982 | Miller | 208/67 |
| 4,395,327 | 7/1983 | Pelrine | 208/216 |
| 4,412,087 | 10/1983 | Trepka | 585/12 |
| 4,428,825 | 1/1984 | Ward et al. | 208/109 |
| 4,428,862 | 1/1984 | Ward et al. | 502/77 |
| 4,431,517 | 2/1984 | Nevitt et al. | 208/111 |
| 4,437,975 | 3/1984 | Gillespie et al. | 208/87 |
| 4,490,242 | 12/1984 | Oleck et al. | 208/97 |

*Primary Examiner*—Andrew H. Metz
*Assistant Examiner*—Glenn Caldarola
*Attorney, Agent, or Firm*—Dean Sandford; Gregory F. Wirzbicki

[57] ABSTRACT

Full-range shale oils or fractions thereof, after hydrotreating, are hydrodewaxed and then hydrogenated to produce lubricating oil fractions boiling above 650° F., having a pour point at or below +10° F., and a viscosity index of at least 95.

74 Claims, 1 Drawing Figure

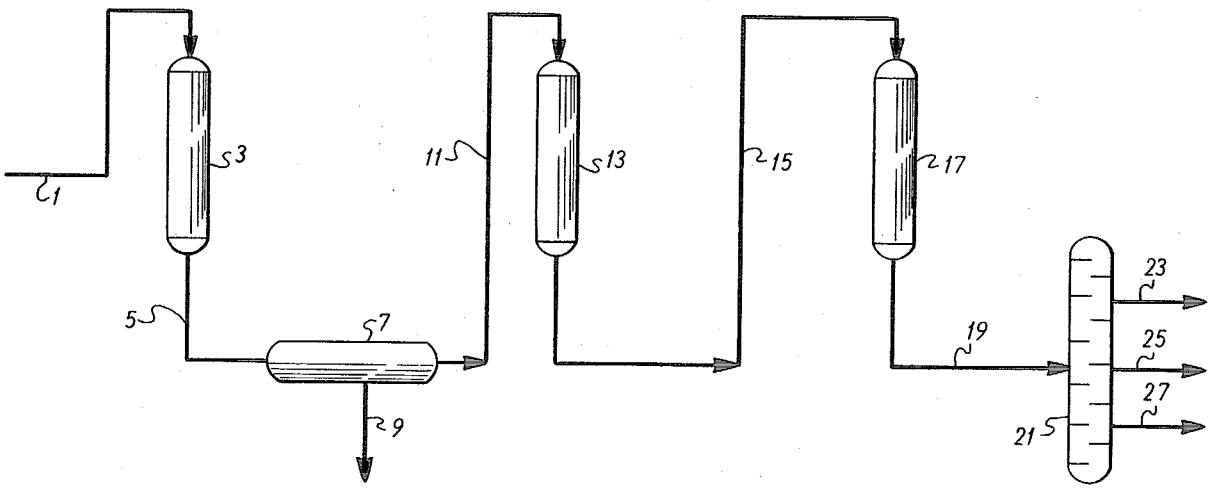
1
3
5
7
9
11
13
15
17
19
21
23
25
27

PROCESS FOR PRODUCING LUBRICATION OIL OF HIGH VISCOSITY INDEX FROM SHALE OILS

BACKGROUND OF THE INVENTION

This invention relates to the production of premium lubricating base oils from shale oils.

Methods of recovering a raw shale oil from oil shale are well known, and as with petroleum crudes, a raw shale oil (sometimes called a syncrude) must be upgraded to products which are of commercial utility. For example, in U.S. Pat. No. 4,428,862, a method is taught for successively deashing, dearseniting, hydrotreating and hydrodewaxing a raw shale oil so as to produce a "pipelineable" shale oil having a relatively low pour point (i.e., +30° F. or less). Such pipelineable shale oils are disclosed to contain various jet fuel and diesel fuel fractions meeting appropriate commercial freeze point and pour point requirements.

Another product of commercial interest is lubricating base oil. Lubricating base oils are generally categorized by their boiling point range, as shown in the following table:

TABLE I

| Lubricating Base Oil Designation | Typical Boiling Point Range, °F. |
|---|---|
| Light Neutral | 650 to 825 |
| Medium Neutral | 700 to 925 |
| Heavy Neutral | 800 to 1025 |
| Bright Stock | 1000+ |

Commercially acceptable lubricating oils generally are composed of blends of base oils having a pour point no greater than +10° F. while also having viscosity indices typically between 90 and 100. Viscosity index is a measure of how well a lubricating oil maintains its viscosity as a function of temperature, with ever increasing viscosity index values being indicative of oils which better maintain their viscosity with change in temperature. For most lubricating oils, a desired viscosity index is 95 or higher.

Yet another product of commercial interest is transformer oil, which typically boils in the range of 610° to 650° F. For transformer oils, there is no viscosity index requirement, since temperature fluctuations in transformer service are minimal. However, there are stringent pour point requirements. Transformer oils are required to have a pour point no greater than −40° F.

SUMMARY OF THE INVENTION

The present invention provides a process for treating a hydrotreated, full-range shale oil so as to obtain a product shale oil containing lubricating base oils of desirable pour point and viscosity index characteristics. Specifically, the process involves first hydrodewaxing the hydrotreated, full-range shale oil in the presence of a hydrodewaxing catalyst, which typically contains one or more hydrogenation components on a support containing a dewaxing component, such as ZSM-5, silicalite, mordenite, and the like, and then hydrogenating the resultant product in the presence of a hydrogenation catalyst, which typically contains a hydrogenation metal component on a support. Preferred operation involves using as the hydrodewaxing catalyst a composite containing nickel and tungsten components on a support containing above about 70 percent by weight silicate and the remainder an amorphous refractory oxide such as alumina and using as the hydrogenation catalyst the catalyst disclosed in U.S. Pat. No. 3,637,484, i.e., platinum and/or palladium deposited selectively by cation exchange upon a silica-alumina cogel or copolymer dispersed in a large pore alumina gel matrix. Preferred operation also involves operating the hydrogenation stage of the process at a temperature above 700° F., with temperatures between 725° 750° F. being highly preferred.

The shale oil product produced by the process of the invention, when fractionated, yields lubricating base oils suitable for commercial use, having a pour point at or below +10° F. and a viscosity index of at least 95.

BRIEF DESCRIPTION OF THE DRAWING

The drawing depicts in flow sheet format a preferred process carried out in accordance with the invention.

DETAILED DESCRIPTION OF THE INVENTION

This invention is directed to producing quality (or premium) lubricating base oils from raw shale oil, and particularly from shale oil derived from oil shale from the Colorado River formation and adjacent areas in the western United States. Shale oil may be recovered from such shales by pyrolysis in a retort and may then be upgraded by any of several methods. In one upgrading method, as disclosed in U.S. Pat. No. 4,428,862 herein incorporated by reference in its entirety, a full-range (i.e., non-fractionated) raw shale oil is successively (1) deashed by filtration or electrostatic agglomeration, (2) dearsenified by contact with a catalyst containing nickel and molybdenum components on an amorphous, porous refractory oxide support in a manner similar to that disclosed in U.S. Pat. No. 4,046,674, herein incorporated by reference in its entirety, (3) hydrotreated at elevated temperature and pressure in the presence of a catalyst comprising Group VIB and VIII metal components on a refractory oxide support, and (4) finally, hydrodewaxed in the presence of a catalyst comprising a Group VIB metal component on a supporting containing silicalite.

When upgrading full-range shale oil derived from Colorado oil shale or the like in accordance with the method disclosed in U.S. Pat. No. 4,428,862, it has been found that the product yielded from the hydrotreating stage, when fractionated, contains lubrication oil fractions having commercially unacceptable pour points, i.e., on the order of +35° F. or more. But it has also been found, when the hydrodewaxing catalyst is modified to contain more than 70 percent silicalite in the support, and when the full range shale oil is hydrodewaxed to an overall pour point less than −40° F., that the product yielded from the hydrodewaxing stage contains lube oil fractions of acceptable pour point, i.e., +10° F. or less, but of drastically reduced viscosity index—substantially below 95. These facts are demonstrated in the following Example I:

EXAMPLE I

A full-range raw shale oil derived from a Colorado oil shale, designated F-3903 and having a boiling range of about 200° to 1100° F., was deashed by electrostatic precipitation and then dearsenified in the presence of a sulfided nickel-molybdenum catalyst containing an essentially non-cracking support. The dearsenification was accomplished by the method described in U.S. Pat.

Nos. 4,046,674 and 4,428,862. The catalyst was composed of about 42 percent by weight of nickel components, calculated as NiO, and about 8 percent by weight of molybdenum components, calculated as $MoO_3$, on an alumina support. The catalyst was in the form of particulates having a cross-sectional shape of a three-leaf clover, as disclosed in FIGS. 8 and 8A in U.S. Pat. No. 4,028,227, said catalyst having a maximum cross-sectional length "D" shown in said FIG. 8A of about 1/22 inch.

The dearsenified product was then hydrotreated in the presence of a sulfided catalyst comprising about 4 percent by weight nickel components (calculated as NiO), about 24 percent by weight of molybdenum components (calculated as $MoO_3$), and about 4 percent by weight of phosphorus (calculated as P) on an alumina support. The hydrotreating catalyst, having a mean pore diameter between about 75 and 80, about 75 percent of its pore volume in pores of diameter between 60 and 100 angstroms, and a surface area of about 160 $m^2/gm$, was about 1/20 inch in its longest cross-sectional length. The catalyst was of quadrilobal shape wherein two relatively large lobes of about equal size shared the same axis, which axis was at a right angle to a second axis containing two relatively small lobes of about equal size. The hydrotreating was accomplished under conditions of elevated temperature and pressure, and in the presence of hydrogen, so as to yield a product containing less than 700 wppm nitrogen, and specifically, to yield a product containing 500 wppm nitrogen. The following Table II summarizes the properties of various fractions of the hydrotreated product boiling in the lubricating and transformer oil ranges:

TABLE II

| Fraction °F. | Gravity °API | Vol. % of Product | Pour Point, °F. | VI |
|---|---|---|---|---|
| 610–650 | 33.7 | 9.19 | 43 | 84.2 |
| 650–690 | 31.9 | 7.22 | 59 | 83.4 |
| 690–790 | 29.6 | 13.84 | 81 | 101.3 |
| 790–830 | 28.4 | 5.30 | 97 | 107.2 |
| 830–875 | 27.6 | 8.46 | 108 | 107.2 |
| 875+ | 26.3 | 13.66 | >113 | 102.3 |
| | Total | 57.67 | | |

As shown by the foregoing data, all of the fractions boiling above 610° F. had a pour point far greaater than the +10° F. maximum desired for lubricating base oils.

The hydrotreated shale oil containing the transformer and lubrication oil fractions identified in Table II and having an API gravity of 33.6 and a pour point of about 80° F. was then hydrodewaxed in the presence of a sulfided, particulate catalyst comprising 2.17 weight percent nickel components, calculated as NiO, and 14.5 weight percent of tungsten components, calculated as $WO_3$, on a support consisting essentially of 80 percent by weight silicalite and 20 percent by weight of alumina and Catapal TM alumina binder. The catalyst had a cylindrical shape and a cross-sectional diameter of 1/16 inch. The operating conditions used in the experiment were as follows: 750° F. operating temperature, 2,000 p.s.i.g. total pressure, 16,000 $ft^2$/bbl of hydrogen (once through), and a space velocity of 1.0 v/v/hr. The properties of the lubricating and transformer fractions in the resultant product, which product had an overall pour point of −65° F., are summarized in the following Table III:

TABLE III

| Fraction °F. | Gravity °API | Vol. % of Product | Pour Point, °F. | VI |
|---|---|---|---|---|
| 610–650 | 28.6 | 7.36 | −65 | 40.8 |
| 650–690 | 27.7 | 5.97 | −60 | 32 |
| 690–790 | 26.2 | 11.63 | −54 | 37.3 |
| 790–830 | 26 | 6.48 | −27 | 57.9 |
| 830–875 | 25.2 | 6.50 | 10 | 65.2 |
| 875+ | 26.1 | 10.70 | 10 | 83.9 |
| | Total | 48.64 | | |

As shown in Table III, the pour points of all the various fractions were acceptable, being at or below 10° F. in the case of lube oils and below −40° F. in the case of the transformer oil boiling in the 610° to 650° F. range. However, the viscosity indices of the lube oil fractions, i.e., those boiling above about 650° F., were clearly incompatible with the desired goal, being far below the 95 value required for commercially acceptable lubricating base oils.

The foregoing example confirms that the deashing-dearseniting-hydrotreating-hydrodewaxing process described in U.S. Pat. No. 4,428,862, although yielding a shale oil having an overall pour point suited for transport in a pipeline, does not yield even one lubricating oil fraction having the desired viscosity index of 95 or more. In the present invention, this problem is overcome by hydrogenating the shale oil product, after hydrodewaxing, in the presence of a hydrogenation catalyst, such as that described in U.S. Pat. No. 3,637,484, herein incorporated by reference in its entirety. In so doing, it has been found that all the lubricating oil fractions will meet appropriate pour point and viscosity index requirements. This result is considered surprising, not only because the viscosity index of the various lube oil fractions in the hydrodewaxed shale oil is so low to begin with but also because hydrogenation generally tends to increase the pour point. See for example column 13, lines 4 to 17 of U.S. Pat. No. 4,428,862. However, as is shown by the data in the following Example II, hydrogenation of the hydrodewaxed shale oil yields lubricating oils having a pour point at or below +10° F. and a viscosity index of 95 or more.

EXAMPLE II

The product of the hydrodewaxing treatment described in Example I, having a gravity of 35.9 API and a pour point overall of −65° F. was then hydrogenated in the presence of a noble metal-containing catalyst at a temperature of 750° F. and at a space velocity of 0.5 v/v/hr and at a pressure of 2,000 p.s.i.g. and a hydrogen feed rate (once through) of about 8,000 $ft^3$/bbl. The catalyst comprises about 0.55 to 0.60 weight percent platinum on a support containing, overall, about 75 weight percent alumina and about 25 weight percent silica. The catalyst is prepared by a method similar to that described in U.S. Pat. No. 3,637,484 wherein the platinum is introduced by cation exchange on a carrier prepared by mulling about 33 parts by dry weight of a 75/25 silica-alumina "graft copolymer" with 67 parts by dry weight of hydrous alumina gel, followed by spray-drying, rehomogenization with added water, extrusion, and calcination. The catalyst is in the form of cylindrical particulates of about 1/12-inch diameter and length of between about 1/16 and 178 inch. The shale oil product, having an API gravity of 44, yielded from the hydrogenation treatment was found to have lubricating oil and transformer oil fractions having the characteristics summarized in the following Table IV:

TABLE IV

| Fraction °F. | Gravity °API | Vol. % of Product | Pour Point, °F. | VI |
|---|---|---|---|---|
| 610–650 | 35 | 6.58 | −54 | 76.8 |
| 650–690 | 34.7 | 7.28 | −27 | 80.8 |
| 690–790 | 34.7 | 10.30 | −11 | 95.2 |
| 790–830 | 35.1 | 3.24 | 0 | 109.7 |
| 830–875 | 34.1 | 3.52 | 10 | 120.4 |
| 875+ | 33.5 | 4.95 | 10 | 129.5 |
| | Total | 35.87 | | |

As shown, the transformer oil fraction boiling between 610° and 650° F. has a pour point substantially below −40° F., and all of the lubricating oil fractions had a pour point at or below +10° F. and a viscosity index of at least 95, with the sole exception of the 650° to 690° F. lube fraction. It should be noted that the low viscosity index value for the 650° to 690° F. lube fraction is of no real concern, since it can easily be blended with the next two higher fractions and still yield a light natural oil of appropriate characteristics: In this respect, it should be recognized that the data in Tables II through IV indicate the characteristics of extremely narrow lubricating oil cuts, and that, in commercial practice, much wider cuts are usually employed. The reason that narrow cuts were analyzed in the two Examples herein was to clearly illustrate how each of the hydrotreating, hydrodewaxing, and hydrogenation steps affected the various components of lubricating oils.

The invention can be more thoroughly understood by reference to the drawing and the following discussion. In conduit 1 is carried a full-range shale oil, and preferably a full-range shale oil which has been deashed and dearsenated, with the preferred method for dearsenating being disclosed in U.S. Pat. Nos. 4,428,862 and 4,046,674. The dearsenation treatment may, in addition to removing essentially all the arsenic contained in the raw shale oil, also reduce the nitrogen and sulfur contents of the shale oil, which are usually above about 1.5 and 0.4 weight percent, respectively, when derived from Colorado oil shale; however, while the sulfur reductions are substantial, usually on the order of about 30 to 70 percent, the nitrogen reductions are usually relatively small, e.g., on the order of 10 to 15 percent. Thus, since greater nitrogen reductions are almost always desired, the feed in conduit 1 is introduced into a hydrotreater 3 and therein contacted with a hydrotreating catalysst in the presence of hydrogen under conditions suited to effecting substantial nitrogen reductions, typically and preferably to a value below 700 wppm. The hydrotreating conditions will generally fall into the ranges shown in the following Table V:

TABLE V

HYDROTREATING OPERATING CONDITIONS

| Condition | Usual | Preferred |
|---|---|---|
| Temperature, °F. | 600–800 | 650–750 |
| Space Velocity, v/v/hr | 0.1–5.0 | 0.3–2.0 |
| Pressure, p.s.i.g. | 500–2,500 | 1,000–2,500 |
| $H_2$ Recycle Rate, scf/bbl | 4,000–20,000 | 6,000–12,000 |
| $H_2$ Mole Percent in Recycle Gases | >85 | >90 |

Any conventional hydrotreating catalyst may be employed in hydrotreater 3, and these generally comprise a Group VIB metal component and a Group VIII metal component on an amorphous, porous refractory oxide support, with the most typical and preferred support being an essentially non-cracking material such as alumina. Preferably, the hydrotreating catalyst contains nickel and/or cobalt components as the Group VIII metal component and molybdenum and/or tungsten components as the Group VIB metal component. Optionally, the catalyst may also contain other components, such as phosphorus, and usually the catalyst is activated by sulfiding prior to use or in situ. Usually, the hydrotreating catalyst contains the Group VIII metal component in a proportion between about 0.5 and 15 percent by weight, preferably between 1 and 5 percent by weight, calculated as the metal monoxide, and the Group VIB metal component in a proportion between about 5 and 40 percent by weight, and preferably between about 15 and 30 percent by weight, calculated as the metal trioxide, on an alumina or other porous refractory oxide support providing a surface area in the final catalyst of at least 100 $m^2$/gm, preferably more than 125 $m^2$/gm. The most prefered catalyst for present use as a hydrotreating catalyst contains about 4 weight percent of nickel components (calculated as NiO) and about 24 weight percent of molybdenum components (calculated as $MoO_3$) and about 3 to 4 weight percent of phosphorus components (calculated as P) on an alumina support, with the catalyst having a surface area in the range of 150 to 175 $m^2$/gm and a mean pore diameter between about 75 and 85 angstroms and a pore size distribution such that at least 75 percent of the pores are in the range of 60 to 100 angstroms.

After hydrotreating, the shale oil product recovered in conduit 5 is substantially reduced in sulfur and nitrogen content, with the former being typically reduced from a value in the range of 0.2 to 1.0 weight percent to values in the 30 to 2,000 wppm range while the latter is reduced from a value in the range of 1.4 to 2.0 weight percent to values below 700 wppm, often as low as 200 to 350 wppm. Since the sulfur and nitrogen, respectively, are converted in hydrotreater 3 to hydrogen sulfide and ammonia, both of these gases are removed in liquid/gas separator 7 and carried away in conduit 9. The remaining liquid shale oil product, although substantially free of sulfur and nitrogen and perhaps having acceptable viscosity indices for some lubricating oil fractions, has a substantially increased overall pour point due to the conversion of olefins to paraffins, with the increase generally being from an original value of about 50° to 60° F. to about 65° to 80° F. for typical Colorado shale oil. In addition, the pour points of most and usually all the lube oil fractions will be unacceptably high, as exemplified hereinbefore in Example I.

The hydrotreated shale oil is introduced via conduit 11 into hydrodewaxing reactor 13 and contacted therein with a hydrodewaxing catalyst under hydrodewaxing conditions so as to substantially reduce the pour point of the hydrotreated shale oil. The conditions of operation in the hydrodewaxing reactor are generally selected as follows:

TABLE VI

HYDRODEWAXING OPERATING CONDITIONS

| Condition | Usual | Preferred |
|---|---|---|
| Temperature, °F. | 650–800 | 700–775 |
| Space Velocity, v/v/hr | 0.1–5.0 | 0.3–2.0 |
| Pressure, p.s.i.g. | 500–2,500 | 1,000–2,500 |
| $H_2$ Recycle Rate, SCF/bbl | 4,000–20,000 | 10,000–18,000 |
| $H_2$ Mole Percent | >40 | >40 |

TABLE VI-continued

| HYDRODEWAXING OPERATING CONDITIONS | | |
|---|---|---|
| Condition | Usual | Preferred |
| in Recycle Gases | | |

When treating full-range hydrotreated shale oil derived from the western United States, and particularly from the Colorado River formation, it is preferred that conditions for hydrodewaxing be selected and correlated with each other such that the overall pour point is reduced to a value below −40° F., for example, about −65° F.

The hydrodewaxing catalyst may be any having hydrodewaxing catalytic activity, with many such catalysts being presently known. Catalysts comprising a noble metal such as platinum on a large port mordenite-containing support are well known as hydrodewaxing catalysts, as are many catalysts containing a hydrogenation component on a support containing an intermediate pore molecular sieve such as silicalite, ZSM-5, ZSM-11, and the like. The term "intermediate pore" refers to those substances containing a substantial number of pores in the range of about 5 to about 7 angstroms. The term "molecular sieve" as used herein refers to any material capable of separating atoms or molecules based on their respective dimensions. The preferred molecular sieve is a crystalline material, and even more preferably, a crystalline material of relative uniform pore size. The term "pore size" as used herein refers to the diameter of the largest molecule that can be sorbed by the particular molecular sieve in question. The measurement of such diameters and pore sizes is discussed more fully in Chapter 8 of the book entitled "Zeolite Molecular Sieves" written by D. W. Breck and published by John Wiley & Sons in 1974, the disclosure of which book is hereby incorporated by reference in its entirety.

The intermediate pore crystalline molecular sieve which forms one of the components of the preferred hydrodewaxing catalyst may be zeolitic or nonzeolitic, has a pore size between about 5.0 and about 7.0 angstroms, possesses cracking activity, and is normally comprised of 10-membered rings of oxygen atoms. The preferred intermediate pore molecular sieve selectively sorbs n-hexane over 2,2-dimethylbutane. The term "zeolitic" as used herein refers to molecular sieves whose frameworks are formed of substantially only silica and alumina tetrahedra, such as the framework present in ZSM-5 type zeolites. The term "nonzeolitic" as used herein refers to molecular sieves whose frameworks are not formed of substantially only silica and alumina tetrahedra. Examples of nonzeolitic crystalline molecular sieves which may be used as the intermediate pore molecular sieve include crystalline silicas, silicoaluminophosphates, chromosilicates, aluminophosphates, titanium aluminosilicates, titanium-aluminophosphates, ferrosilicates, and borosilicates, provided, of course, that the particular material chosen has a pore size between about 5.0 and about 7.0 angstoms. A more detailed description of silicoaluminophosphates, titanium-aluminophosphates, and the like, which are suitable as intermediate pore molecular sieves for use in the invention, are disclosed more fully in U.S. patent application Ser. No. 768,487 filed on Aug. 22, 1985 in the name of John W. Ward, which application is herein incorporated by reference in its entirety.

The most suitable zeolites for use as the intermediate pore molecular sieve in the preferred hydrodewaxing catalyst are the crystalline aluminosilicate zeolites of the ZSM-5 type, such as ZSM-5, ZSM-11, ZSM-12, ZSM-23, ZSM-35, ZSM-38, and the like, with ZSM-5 being preferred. ZSM-5 is a known zeolite and is more fully described in U.S. Pat. No. 3,702,886 herein incorporated by reference in its entirety; ZSM-11 is a known zeolite and is more fully described in U.S. Pat. No. 3,709,979, herein incorporated by reference in its entirety; ZSM-12 is a known zeolite and is more fully described in U.S. Pat. No. 3,832,449, herein incorporated by reference in its entirety; ZSM-23 is a known zeolite and is more fully described in U.S. Pat. No. 4,076,842, herein incorporated by reference in its entirety; ZSM-35 is a known zeolite and is more fully described in U.S. Pat. No. 4,016,245, herein incorporated by reference in its entirety; and ZSM-38 is a known zeolite and is more fully described in U.S. Pat. No. 4,046,859, herein incorporated by reference in its entirety. These zeolites are known to readily adsorb benzene and normal paraffins, such as n-hexane, and also certain mono-branched paraffins, such as isopentane, but to have difficulty adsorbing di-branched paraffins, such as 2,2-dimethylbutane, and polyalkylaromatics, such as metaxylene. These zeolites are also known to have a crystal density not less than 1.6 grams per cubic centimeter, a silica-to-alumina ratio of at least 12, and a constraint index, as defined in U.S. Pat. No. 4,229,282, incorporated by reference herein in its entirety, within the range of 1 to 12. The foregoing zeolites are also known to have an effective pore diameter greater than 5 angstroms and to have pores defined by 10-membered rings of oxygen atoms, as explained in U.S. Pat. No. 4,247,388, herein incorporated by reference in its entirety. Such zeolites are preferably utilized in the acid form, as by replacing at least some of the metals contained in the ion exchange sites of the zeolite with hydrogen ions. This exchange may be accomplished directly with an acid or indirectly by ion exchange with ammonium ions followed by calcination to convert the ammonium ions to hydrogen ions. In either case, it is preferred that the exchange be such that a substantial proportion of the ion exchange sites utilized in the catalyst support be occupied with hydrogen ions.

The most preferred intermediate pore crystalline molecular sieve that may be used as a component of the preferred hydrodewaxing catalyst is a crystalline silica molecular sieve essentially free of aluminum and other Group IIIA metals. (By "essentially free of Group IIIA metals" it is meant that the crystalline silica contains less than 0.75 percent by weight of such metals in total, as calculated as the trioxides thereof, e.g., $Al_2O_3$.) The preferred crystalline silica molecular sieve is a silica polymorph, such as the material described in U.S. Pat. No. 4,073,685. One highly preferred silica polymorph is known as silicalite and may be prepared by methods described in U.S. Pat. No. 4,061,724, the disclosure of which is hereby incorporated by reference in its entirety. Silicalite does not share the zeolitic property of substantial ion exchange common to crystalline aluminosilicates and therefore contains essentially no zeolitic metal cations. Unlike the "ZSM family" of zeolites, silicalite is not an aluminosilicate and contains only trace proportions of alumina derived from reagent impurities. Some extremely pure silicalites (and other microporous crystalline silicas) contain less than about 100 ppmw of Group IIIA metals, and yet others less than 50 ppmw, calculated as the trioxides.

The preferred hydrodewaxing catalyst chosen for use in reactor 13 contains a hydrogenation component in addition to one or more of the foregoing described intermediate pore molecular sieves. Typically, the hydrogenation component comprises a Group VIB metal component, and preferably both a Group VIB metal component and a Group VIII metal component are present in the catalyst, with the usual and preferred proportions thereof being as specified hereinabove with respect to the hydrotreating catalyst. Also included in such a catalyst, at least in the preferred embodiment, is a porous refractory oxide, such as alumina, which is mixed with the intermediate pore molecular sieve to provide a support for the active hydrogenation metals. The preferred catalyst contains cobalt and/or nickel components as the Group VIII metal component and molybdenum and/or tungsten as the Group VIB metal component on a support comprising alumina and either ZSM-5 and/or silicalite as the intermediate pore molecular sieve. The most preferred catalyst, usually having a surface area above about 200 $m^2$/gm, is a sulfided catalyst containing nickel components and tungsten components on a support comprising silicalite or ZSM-5 and alumina, with silicalite being the most preferred of all.

One surprising discovery in the present invention is that, at least for hydrotreated Colorado shale oils, the most highly preferred hydrodewaxing catalyst disclosed in U.S. Pat. No. 4,428,862, containing 30 percent by weight silicalite in the support, provides inferior results in the present invention. Specifically, it has been found that the silicalite content of the support must be above about 70 percent by weight, for example, 80 percent by weight, to ensure that all the resultant lube oil fractions will meet the pour point requirement of +10° F. or less. Thus, in the most highly preferred embodiment of the present invention, when a silicalite-containing catalyst, and especially a nickel-tungsten-alumina-silicalite catalyst, is employed as the hydrodewaxing catalyst, silicalite is provided in the support in a proportion of at least 70 percent, and even more preferably, at about 80 percent by weight. (Although no data have yet been obtained for other intermediate pore molecular sieves such as ZSM-5 and ZSM-11, it is believed that such sieves will also provide better performance when present at relatively high levels of 70 percent by weight or more in the support. Therefore it is preferred in these embodiments that the molecular sieve be provided in the relatively high levels of 70 percent by weight or more.)

After hydrodewaxing, the treated shale oil is passed by line 15 to hydrogenation reactor 17 and therein contacted with a catalyst comprising a hydrogenation metal component, and preferably a noble metal-containing hydrogenation component, under conditions of elevated temperature and pressure and the presence of hydrogen. The preferred hydrogenation catalyst contains an amorphous support, and even more preferably consists essentially of an amorphous support, such as alumina, silica, silica-alumina, etc. The most preferred catalysts are those disclosed in U.S. Pat. No. 3,637,484 which contain platinum and/or palladium dispersed, as by cation exchange, on a support comprising silica-alumina dispersed in an alumina matrix. The most highly preferred of these catalysts are those containing a platinum component as the hydrogenation metal component. The conditions under which the shale oil is passed through the hydrogenation catalyst bed are correlated so as to yield a shale oil product containing at least one lubricating oil fraction, boiling essentially completely above about 690° F. and having at least about a 40° F. differential between the initial and end boiling points, which fraction has a pour point no greater than +10° F. and a viscosity index of at least 95. Typical conditions are selected from the following Table VII:

TABLE VII

| | Usual | Preferred |
|---|---|---|
| Temperature, °F. | 600–800 | 725–775 |
| Pressure, p.s.i.g. | 500–2,500 | 1,500–2,500 |
| Space Velocity, v/v/hr | 0.1–5.0 | 0.2–2.0 |
| $H_2$ Recycle Rate, scf/bbl | 4,000–20,000 | 6,000–16,000 |
| $H_2$ Mole Percent in Recycle Gas | >85 | >90 |

Another surprising discovery uncovered in the present invention is that, whereas the disclosure in U.S. Pat. No. 3,637,484 teaches operating temperatures of 300° to 700° F., it has been found in the present invention that, to maximize the number of lube oil fractions meeting acceptable pour point and viscosity index requirements, a temperature above 700° F., and usually a temperature in the range of 725° to 800° F. is required, with temperatures above 800° F. usually being avoided because of metallurgical constraints associated with the construction materials of reactor 17. Highly preferred temperatures lie in the range of about 725° to 750° F., and the most highly preferred operating temperature is 750° F.

Subsequent to hydrogenation, the shale oil is carried via line 19 to fractionator 21, wherein one or more quality lubricating oil or transformer oil fractions are produced and individually recovered via lines 23, 25, and 27.

One tremendous advantage of the present invention is that, where the process of U.S. Pat. No. 4,428,862 yields a pipelineable shale oil, the added capital expense for a hydrogenation stage as required in the present invention is more than made up for by the higher value of the shale oil lube products yielded. For example, adding the extra hydrogenation stage is estimated to increase the capital expense of the upgrading process taught in U.S. Pat. No. 4,428,862 by about 20 to 25 percent but the value of the product is roughly doubled.

Another advantage in the invention is that, although the hydrotreating stage is primarily relied upon for reducing the nitrogen and sulfur contents of the shale oil, the hydrodewaxing and hydrogenation stages also effect some reduction in nitrogen and sulfur because of the hydrogenation metals on the catalysts, the elevated temperatures of operation, and the presence of hydrogen. In addition, it has been found that the lubricating oils produced by the method of the invention are highly resistant to sediment formation when exposed to U.V. light. This result is especially of significance, since it is known that lubricating oils produced from shale oils, and in particular from shale oil derived from Colorado oil shale, are characterized by a tendency to develop sediment when exposed to light, with the U.V. component thereof being the known inducer of the sedimentation problem. Thus, it is a distinct advantage in the invention to be able to produce a premium lubricating oil without the additional expense of additives or further refining steps in order to avoid difficulties with sedimentation.

Although the invention has been described in conjunction with preferred embodiments, examples, and a drawing, many modifications, variations, and alternatives of the invention will be apparent to those skilled in the art. For example, although the drawing shows the various reactor vessels in downflow configuration, one can also use upflow operation, and indeed, upflow operation may prove more advantageous. Similarly, the drawing shows serial operation with the full-range hydrotreated shale oil being treated in each stage. However, one may also, for example, between the hydrotreating and hydrodewaxing stages, fractionate the shale oil into one or more desired fractions boiling above 610° F., and then individually hydrodewax and hydrogenate each of the recovered fractions requiring further processing to meet appropriate pour point or VI requirements. This alternative embodiment has, of course, the disadvantages of a higher capital cost and greater complexity of operation, but these disadvantages are offset by the advantages of higher yields and less severe operating conditions required for hydrodewaxing and hydrogenation. In yet another embodiment, which is indeed the most highly preferred at the present time, the full-range shale oil is fractionated prior to hydrotreating, for example, into an X−610° F. fraction, a 610°–800° F. fraction, and an 800° F.+ fraction. The heavier fractions may then be separately and serially hydrotreated, hydrocracked, and hydrogenated in accordance with the invention. More preferably, however, all fractions boiling above 610° F. are recombined and then serially hydrotreated, hydrocracked and hydrogenated in accordance with the invention. Accordingly, it is intended to embrace within the invention these and all modifications, variations, and alternatives as fall within the spirit and scope of the appended claims.

We claim:

1. A process for producing a premium lubricating base oil from a full-range shale oil or fraction thereof, which process comprises:

(1) hydrotreating a nitrogen-containing or sulfur-containing full-range shale oil or fraction thereof containing components boiling above 650° F. in the presence of hydrogen and a hydrotreating catalyst under conditions of elevated temperature and pressure which reduce the nitrogen content or sulfur content thereof;

(2) hydrodewaxing the resultant hydrotreated shale oil product in the presence of hydrogen and a hydrodewaxing catalyst containing a crystalline molecular sieve under conditions of elevated temperature and pressure which reduce the pour point thereof; and (3) hydrogenating the resultant hydrodewaxed shale oil product in the presence of hydrogen and a hydrogenating catalyst consisting essentially of one or more hydrogenation components on an amorphous support under conditions of elevated temperature and pressure producing at least one lubricating base oil fraction having a pour point no greater than +10° F. and a viscosity index of at least 95, said lubricating base oil fraction boiling above 650° F.

2. A process as defined in claim 1 wherein said lubricating base oil fraction has an initial and final boiling point differential of at least 40° F.

3. A process as defined in claim 2 wherein said full-range shale oil or fraction thereof is derived from oil shale from the western United States.

4. A process as defined in claim 1 wherein said hydrotreating results in substantial reductions in the nitrogen or sulfur content, the hydrodewaxing results in a substantial reduction in the pour point, and the hydrogenation results in the production of at least two lubricating oil base fractions boiling above 650° F. and having a pour point no greater than +10° F. and a viscosity index of at least 95, said lubricating oil base fractions having an initial and final boiling point differential of at least 40° F.

5. A process for producing a premium lubricating base oil from a hydrotreated full-range shale oil or fraction thereof, which process comprises:

(1) hydrodewaxing a hydrotreated full-range shale oil or fraction thereof, which contains components boiling above 650° F., in the presence of hydrogen and a hydrodewaxing catalyst under conditions of elevated temperature and pressure so as to reduce the pour point thereof and reduce the viscosity index of the components boiling above 650° F.; and (2) hydrogenating the resultant hydrodewaxed shale oil product in the presence of hydrogen and a hydrogenating catalyst under conditions of elevated temperature and pressure so as to increase the viscosity index of the components boiling above 650° F. and produce at least one lubricating base oil fraction having a pour point no greater than +10° F. and a viscosity index of at least 95, said lubricating base oil fraction boiling above 650° F.

6. A process as defined in claim 5 wherein said hydrotreated full-range shale oil or fraction thereof is relatively low in sulfur or nitrogen.

7. A process as defined in claim 5 wherein said hydrodewaxing catalyst comprises an intermediate pore crystalline molecular sieve and said hydrogenation catalyst comprises a Group VIII metal component.

8. A process as defined in claim 5 wherein said hydrodewaxing catalyst comprises a Group VIB hydrogenation component and an intermediate pore crystalline molecular sieve and said hydrogenation catalyst comprises a noble metal component on a support.

9. A process as defined in claim 8 wherein said molecular sieve comprises a material having a pore size between about 5 and about 7 angstroms and is selected from the group consisting of aluminosilicate zeolites, crystalline silicas, silicoaluminophosphates, chromosilicates, titanium-aluminophosphates, ferrosilicates, titanium aluminosilicates, aluminophosphates, and borosilicates.

10. A process as defined in claim 9 wherein said noble metal component is selected from the group consisting of platinum components and palladium components.

11. A process as defined in claim 8 wherein said intermediate pore molecular sieve is selected from the group consisting of silicalite and ZSM-5 zeolite and said noble metal component is selected from the group consisting of platinum components and palladium components.

12. A process as defined in claim 11 wherein said hydrodewaxing catalyst comprises a Group VIB metal component and a Group VIII metal component on a support comprising at least 70 percent by weight of said intermediate pore molecular sieve and said elevated temperature in step (2) is above 700° F.

13. A process as defined in claim 12 wherein said conditions in steps (1) and (2) are adjusted to yield a plurality of lubricating base oil fractions boiling above 650° F. and having a pour point no greater than +10° F. and a viscosity index of at least 95, said lubricating base oil fractions having an initial and final boiling point differential of at least 40° F.

14. A process as defined in claim 12 wherein said hydrogenating in step (2) yields a product wherein the pour point of the entire fraction or product boiling in the 650° F.+ range is at or below 10° F.

15. A process as defined in claim 14 wherein said entire fraction or product has a viscosity index of at least 95.

16. A process as defined in claim 9, 12, or 13 wherein said hydrodewaxing catalyst comprises nickel and tungsten active metal components and contains a support comprising a porous refractory oxide and said hydrogenation catalyst comprises a noble metal component on a support.

17. A process as defined in claim 16 wherein said hydrogenation catalyst comprises (1) a heterogeneous carrier composite of about 10 to 50 weight percent of a silica-alumina cogel or copolymer having a $SiO_2/Al_2O_3$ weight ratio of about 50/50 to 85/15 dispersed in a large pore alumina gel matrix, the composite carrier having a surface area between about 200 and 700 $m^2/g$, and a pore volume of about 0.8 to 2.0 ml/g, with about 0.3 to 1 ml/g of said pore volume being in pores of diameter greater than 500 angstroms; and (2) a minor proportion of a platinum group metal selectively dispersed by cation exchange on said silica-alumina cogel or copolymer from an aqueous solution of a platinum group metal compound wherein the platinum group metal appears in the cation.

18. A process as defined in claim 17 wherein said platinum group metal comprises platinum.

19. A process as defined in claim 18 wherein said hydrotreated full-range shale oil or fraction thereof is derived from oil shale from the western United States.

20. A process as defined in claim 16 wherein said hydrotreated full-range shale oil or fraction thereof is derived from oil shale from the western United States.

21. A process as defined in claim 20 wherein said noble metal component comprises platinum.

22. A process as defined in claim 9, 12, or 13 wherein said hydrotreated full-range shale oil or fraction thereof is derived from oil shale from the western United States.

23. A process as defined in claim 22 wherein said hydrogenation catalyst comprises a platinum component.

24. A process as defined in claim 9, 12, or 13 wherein said hydrotreated full-range shale oil or fraction contains components boiling at or above 610° F. and said hydrogenating yields a 610° to 650° F. fraction having a pour point at or below −40° F.

25. A process as defined in claim 1, 4, 5, 9, 11, 12, or 13 wherein said hydrodewaxing and hydrogenation is carried out upon a full-range shale oil.

26. A process as defined in claim 17 wherein said hydrodewaxing and hydrogenation is carried out upon a full-range shale oil.

27. A process as defined in claim 13 where at least one of said lubricating base oil fractions has an initial boiling point at least 40° F. greater than the end point of a second of said fractions.

28. A process as defined in claim 5 wherein said hydrogenation catalyst comprises (1) a heterogeneous carrier composite of about 10 to 50 weight percent of a silica-alumina cogel or copolymer having a $SiO_2/Al_2O_3$ weight ratio of about 50/50 to 85/15 dispersed in a large pore alumina gel matrix, the composite carrier having a surface area between about 200 and 700 $m^2/g$, and a pore volume of about 0.8 to 2.0 ml/g, with about 0.3 to 1 ml/g of said pore volume being in pores of diameter greater than 500 angstroms; and (2) a minor proportion of a platinum group metal selectively dispersed by cation exchange on said silica-alumina cogel or copolymer from an aqueous solution of a platinum group metal compound wherein the platinum group metal appears in the cation.

29. A process as defined in claim 28 wherein said conditions in steps (1) and (2) are adjusted to yield a plurality of lubricating base oil fractions boiling above 650° F. and having a pour point no greater than +10° F. and a viscosity index of at least 95, said lubricating oil base fractions having an initial and final boiling point differential of at least 40° F.

30. A process as defined in claim 29 where at least one of said lubricating base oil fractions has an initial boiling point at least 40° F. greater than the end point of a second of said fractions.

31. A process as defined in claim 30 wherein said hydrodewaxing catalyst comprises a Group VIB hydrogenation component and an intermediate pore crystalline molecular sieve selected from the group consisting of silicalite and ZSM-5 zeolite and said noble metal component is selected from the group consisting of platinum components and palladium components.

32. A process as defined in claim 31 wherein said hydrodewaxing catalyst comprises a Group VIB metal component and a Group VIII metal component on a support comprising at least 70 percent by weight of said intermediate pore molecular sieve and said elevated temperature in step (2) is above 700° F.

33. A process as defined in claim 32 wherein said hydrotreated full-range shale oil or fraction thereof is derived from oil shale from the western United States.

34. A process as defined in claim 33 wherein said platinum group metal comprises platinum.

35. A process for producing a premium lubricating base oil from a full-range shale oil, which process comprises:

(1) hydrotreating a nitrogen-containing or sulfur-containing full-range shale oil containing components boiling above 650° F. in the presence of hydrogen and a hydrotreating catalyst under conditions of elevated temperature and pressure which reduce the nitrogen content or sulfur content thereof;

(2) hydrodewaxing the resultant hydrotreated shale oil product in the presence of hydrogen and a hydrodewaxing catalyst under conditions of elevated temperature and pressure which reduce the pour point thereof to a value below −40° F. and reduce the viscosity index of the components boiling above 650° F.; and (3) hydrogenating the resultant hydrodewaxed shale oil product in the presence of hydrogen and a hydrogenating catalyst under conditions of elevated temperature and pressure so as to increase the viscosity index of the components boiling above 650° F. and produce at least one lubricating base oil fraction having a pour point no greater than +10° F. and a viscosity index of at least 95, said lubricating base oil fraction boiling above 650° F. and having an initial and final boiling point differential of at least 40° F.

36. A process as defined in claim 35 wherein said full-range shale oil is derived from oil shale from the western United States.

37. A process as defined in claim 36 wherein said hydrotreating results in substantial reductions in the nitrogen or sulfur content, and the hydrogenation results in the production of at least two lubricating oil base fractions boiling above 650° F. and having a pour point no greater than +10° F. and a viscosity index of at least 95, said lubricating oil base fractions having an initial and final boiling point differential of at least 40° F.

38. A process for producing a premium lubricating base oil from a hydrotreated full-range shale oil, which process comprises:

(1) hydrodewaxing a hydrotreated full-range shale oil, which contains components boiling above 650° F., in the presence of hydrogen and a hydrodewaxing catalyst containing a crystalline molecular sieve under conditions of elevated temperature and pressure so as to reduce the pour point thereof to a value below −40° F.; and (2) hydrogenating the resultant hydrodewaxed shale oil product in the presence of hydrogen and a hydrogenating catalyst consisting essentially of one or more hydrogenation components on an amorphous support under conditions of elevated temperature and pressure producing at least one lubricating base oil fraction having a pour point no greater than +10° F. and a viscosity index of at least 95, said lubricating base oil fraction boiling above 650° F.

39. A process as defined in claim 38 wherein said hydrodewaxing catalyst comprises a Groiup VIB hydrogenation component and an intermediate pore crystalline molecular sieve and said hydrogenation catalyst comprises a noble metal component on a support.

40. A process as defined in claim 39 wherein said noble metal component is selected from the group consisting of platinum components and palladium components.

41. A process as defined in claim 39 wherein said intermediate pore molecular sieve is selected from the group consisting of silicalite and ZSM-5 zeolite and said noble metal component is selected from the group consisting of platinum components and palladium components.

42. A process as defined in claim 41 wherein said hydrodewaxing catalyst comprises a Group VIB metal component and a Group VIII metal component on a support comprising at least 70 percent by weight of said intermediate pore molecular sieve and said elevated temperature in step (2) is above 700° F.

43. A process as defined in claim 42 wherein said conditions in steps (1) and (2) are adjusted to yield a plurality of lubricating base oil fractions boiling above 650° F. and having a pour point no greater than +10° F. and a viscosity index of at least 95, said lubricating oil base fractions having an initial and final boiling point differential of at least 40° F.

44. A process as defined in claim 42 wherein said hydrodewaxing catalyst comprises nickel and tungsten active metal components and contains a support comprising a porous refractory oxide and said hydrogenation catalyst comprises a noble metal component on a support.

45. A process as defined in claim 42 wherein said hydrogenation catalyst comprises (1) a heterogeneous carrier composite of about 10 to 50 weight percent of a silica-alumina cogel or copolymer having a $SiO_2/Al_2O_3$ weight ratio of about 50/50 to 85/15 dispersed in a large pore alumina gel matrix, the composite carrier having a surface area between about 200 and 700 $m^2/g$, and a pore volume of about 0.8 to 2.0 ml/g, with about 0.3 to 1 ml/g of said pore volume being in pores of diameter greater than 500 angstroms; and (2) a minor proportion of a platinum group metal selectively dispersed by cation exchange on said silica-alumina cogel or copolymer from an aqueous solution of a platinum group metal compound wherein the platinum group metal appears in the cation.

46. A process as defined in claim 45 wherein said platinum group metal comprises platinum.

47. A process as defined in claim 46 wherein said hydrotreated full-range shale oil is derived from oil shale from the western United States.

48. A process as defined in claim 45 wherein said hydrotreated full-range shale oil is derived from oil shale from the western United States.

49. A process as defined in claim 45 wherein said conditions in steps (1) and (2) are adjusted to yield a plurality of lubricating base oil fractions boiling above 650° F. and having a pour point no greater than +10° F. and a viscosity index of at least 95, said lubricating base oil fractions having an initial and final boiling point differential of at least 40° F., with at least one of said lubricating base oil fractions having an initial boiling point at least 40° F. greater than the end point of a second of said fractions.

50. A process as defined in claim 5 or 41 wherein said conditions in steps (1) and (2) are adjusted to yield a plurality of lubricating base oil fractions boiling above 650° F. and having a pour point no greater than +10° F. and a viscosity index of at least 95, said lubricating base oil fractions having an initial and final boiling point differential of at least 40° F., with at least one of said lubricating base oil fractions having an initial boiling point at least 40° F. greater than the end point of a second of said fractions.

51. A process as defined in claim 2, 4, or 37 wherein said temperature in step (3) is above 700° F.

52. A process as defined in claim 51 wherein said hydrogenating catalyst comprises silica-alumina.

53. A process as defined in claim 7, 10, or 41 wherein said temperature in step (2) is above 700° F.

54. A process as defined in claim 53 wherein said hydrogenating catalyst comprises silica-alumina.

55. A process as defined in claim 45, 47, or 49 wherein said elevated temperature in step (2) is 725° to 75° F.

56. A process as defined in claim 50 wherein said elevated temperature in step (2) is above 700° F.

57. A process as defined in claim 56 wherein said hydrogenating catalyst comprises silica-alumina.

58. A process as defined in claim 28 or 31 wherein said elevated temperature in step (2) is above 700° F.

59. A process as defined in claim 17 wherein said elevated temperature in step (2) is between about 725° and 800° F.

60. A process as defined in claim 28, 31, or 43, wherein said elevated temperature in step (2) is between 725° and 800° F.

61. A process as defined in claim 45, 47, or 49 wherein said elevated temperature in step (2) is between 725° and 800° F.

62. A process as defined in claim 3 wherein said catalyst in step (1) is contacted with a full range shale oil containing from about 1.4 to about 2.0 weight percent of organonitrogen components and, during said contacting in step (1), the organonitrogen content is decreased to below 700 wppm.

63. A process as defined in claim 36 wherein said catalyst in step (1) is contacted with a full range shale oil containing from about 1.4 to about 2.0 weight percent of organonitrogen components and, during said contacting in step (1), the organonitrogen content is decreased to below 700 wppm.

64. A process as defined in claim 37 wherein said catalyst in step (1) is contacted with a full range shale oil containing from about 1.4 to about 2.0 weight percent of organonitrogen components and, during said contacting in step (1), the organonitrogen content is decreased to below 700 wppm.

65. A process as defined in claim 7 or 11 wherein the hydrodewaxing catalyst contains silicalite and the reduction in organonitrogen content during the contacting in step (1) is more than 75 percent.

66. A process as defined in claim 17 wherein the hydrodewaxing catalyst contains silicalite and the reduction in organonitrogen content during the contacting in step (1) is more than 75 percent.

67. A process as defined in claim 19 wherein the hydrodewaxing catalyst contains silicalite and the reduction in organonitrogen content during the contacting in step (1) is more than 75 percent.

68. A process as defined in claim 26 wherein the hydrodewaxing catalyst contains silicalite and the reduction in organonitrogen content during the contacting in step (1) is more than 75 percent.

69. A process as defined in claim 41 wherein the hydrodewaxing catalyst contains silicalite and the reduction in organonitrogen content during the contacting in step (1) is more than 75 percent.

70. A process as defined in claim 45 wherein the hydrodewaxing catalyst contains silicalite and the reduction in organonitrogen content during the contacting in step (1) is more than 75 percent.

71. A process as defined in claim 47 wherein the hydrodewaxing catalyst contains silicalite and the reduction in organonitrogen content during the contacting in step (1) is more than 75 percent.

72. A process as defined in claim 49 wherein the hydrodewaxing catalyst contains silicalite and the reduction in organonitrogen content during the contacting in step (1) is more than 75 percent.

73. A process as defined in claim 55 wherein the hydrodewaxing catalyst contains silicalite and the reduction in organonitrogen content during the contacting in step (1) is more than 75 percent.

74. A process as defined in claim 73 wherein the reduction in organosulfur content during the contacting in step (1) is more than 50 percent.

* * * * *

UNITED STATES PATENT AND TRADEMARK OFFICE

CERTIFICATE OF CORRECTION

PATENT NO. : 4,699,707

DATED : October 13, 1987

INVENTOR(S) : Eric L. Moorehead and Sidney Y. Shen

It is certified that error appears in the above-identified patent and that said Letters Patent is hereby corrected as shown below:

Column 15, line 34, change "Groiup" to --Group--.

Column 16, line 53, after "is" insert --from-- and change "75° F." to --750° F.--.

Signed and Sealed this

Third Day of May, 1988

*Attest:*

*Attesting Officer*

DONALD J. QUIGG

*Commissioner of Patents and Trademarks*